US008833628B2

(12) United States Patent
Schwartzenberger

(10) Patent No.: US 8,833,628 B2
(45) Date of Patent: Sep. 16, 2014

(54) TOOL FREE INTERCHANGEABLE FASTENER GUIDE

(75) Inventor: Julius Westley Schwartzenberger, Northlake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 777 days.

(21) Appl. No.: 13/043,865

(22) Filed: Mar. 9, 2011

(65) Prior Publication Data

US 2012/0228354 A1 Sep. 13, 2012

(51) Int. Cl.

| | |
|---|---|
| ***B25C 5/02*** | (2006.01) |
| ***B25C 5/06*** | (2006.01) |
| ***B25C 5/16*** | (2006.01) |
| ***B25C 1/18*** | (2006.01) |

(52) U.S. Cl.

CPC ..... *B25C 1/188* (2013.01); *B25C 5/1658* (2013.01); *B25C 5/1665* (2013.01)

USPC ..... 227/109

(58) Field of Classification Search

USPC ..... 227/107–139

See application file for complete search history.

(56) References Cited

U.S. PATENT DOCUMENTS

| | | | | | |
|---|---|---|---|---|---|
| 3,854,648 | A | * | 12/1974 | Inzoli et al. | 227/136 |
| 4,346,831 | A | * | 8/1982 | Haytayan | 227/8 |
| 4,436,236 | A | * | 3/1984 | Jobe | 227/123 |
| 4,467,952 | A | * | 8/1984 | Morrell, Jr. | 227/123 |
| 4,483,473 | A | | 11/1984 | Wagdy | |
| 4,520,697 | A | * | 6/1985 | Moetteli | 81/62 |
| 4,522,162 | A | | 6/1985 | Nikolich | |
| 4,549,681 | A | * | 10/1985 | Yamamoto et al. | 227/8 |
| 5,261,587 | A | * | 11/1993 | Robinson | 227/8 |
| 5,452,835 | A | * | 9/1995 | Shkolnikov | 227/8 |
| 5,642,849 | A | | 7/1997 | Chen | |
| 5,649,661 | A | * | 7/1997 | Masuno et al. | 227/8 |
| 5,810,239 | A | * | 9/1998 | Stich | 227/119 |
| 6,012,622 | A | | 1/2000 | Weinger et al. | |
| 6,056,182 | A | * | 5/2000 | Chen | 227/123 |
| 6,145,724 | A | | 11/2000 | Shkolnikov et al. | |
| 6,173,949 | B1 | * | 1/2001 | Visick et al. | 270/58.08 |
| 6,325,268 | B1 | | 12/2001 | Liang | |
| 6,651,862 | B2 | | 11/2003 | Driscoll et al. | |
| 6,679,414 | B2 | | 1/2004 | Rotharmel | |
| 7,032,796 | B1 | | 4/2006 | Lin | |
| 7,314,025 | B2 | | 1/2008 | Shkolnikov et al. | |
| 7,438,206 | B2 | * | 10/2008 | Kumayama | 227/127 |
| 7,516,876 | B2 | * | 4/2009 | Ohmori | 227/119 |
| 7,588,096 | B2 | | 9/2009 | Panasik | |
| 7,802,710 | B1 | * | 9/2010 | Hung | 227/120 |
| 7,975,892 | B2 | * | 7/2011 | Yeh | 227/133 |
| 7,988,025 | B2 | * | 8/2011 | Terrell | 227/119 |

(Continued)

*Primary Examiner* — Robert Long

(74) *Attorney, Agent, or Firm* — Greer, Burns & Crain, Ltd.; Maurice E. Finnegan, III; Mark W. Croll

(57) ABSTRACT

A tool free interchangeable fastener guide is provided for use with a fastener tool having a nosepiece with a captured transverse pin and a back plate. The guide includes a front plate having a tool engaging end and an opposite fastener outlet end, an outer surface and an inner surface. A butt plate is pivotably joined to the outer surface, and a spring clip has a first end pivotably secured to the butt plate and a second end configured for attachment to the fastener tool. The tool engaging end has an open slot constructed and arranged for pivotally engaging the captured pin, the front plate being disengageable from the captured pin without the use of tools.

15 Claims, 7 Drawing Sheets

(56) References Cited

U.S. PATENT DOCUMENTS

| | | | | |
|---|---|---|---|---|
| 8,276,799 | B2 * | 10/2012 | Chen | 227/129 |
| 8,356,534 | B2 * | 1/2013 | Hale et al. | 81/57.37 |
| 2002/0030079 | A1 | 3/2002 | Adachi et al. | |
| 2006/0191971 | A1 * | 8/2006 | Li | 227/107 |
| 2007/0114260 | A1 * | 5/2007 | Petrocelli | 227/130 |
| 2008/0237293 | A1 * | 10/2008 | Ebihara | 227/120 |
| 2009/0294502 | A1 | 12/2009 | Kunz et al. | |
| 2011/0240709 | A1 * | 10/2011 | Oouchi | 227/8 |

* cited by examiner

TOOL FREE INTERCHANGEABLE FASTENER GUIDE

BACKGROUND

The present invention relates generally to fastener driving tools, and more specifically to such tools configured for driving a variety of fasteners.

Fastener driving tools, also known as nailers, are known in the art, and are powered by various systems, including pneumatic, electric, powder and combustion. Combustion tools typically have a housing substantially enclosing a power source, a trigger mechanism and a magazine storing a supply of fasteners for sequential driving. The power source includes a reciprocating driver blade which separates a forwardmost fastener from the magazine and drives it through a noseplate assembly into the workpiece. The nosepiece assembly is also the conventional attachment point for the magazine and defines the entryway for fasteners from the magazine into a fastener passage where impact with the driver blade occurs as well as subsequent transport into the workpiece. Exemplary tools are described in U.S. Pat. Nos. 4,483,473; 4,522,162; 6,145,724; and 6,679,414, all of which are incorporated by reference. A fastener nailer designed for trim work is disclosed in U.S. Pat. No. 6,012,622, incorporated by reference.

One type of combustion fastener nailer is described in commonly-assigned U.S. Pat. No. 6,651,862 which is incorporated by reference. This patent addresses fastener nailers designed for driving trim-type or finishing fasteners, typically nails with small heads. In one known embodiment, a front plate of the nosepiece assembly is pivotable outward to permit full access to the interior of the nosepiece. The front plate is preferably pivotable to at least 90 degrees relative to the vertical operational axis of the tool for enabling the operator to pull out the jammed fasteners perpendicularly to the action of the piston.

Such fasteners tend to become jammed in the fastener tool nosepiece and must be cleared to resume operation of the tool. To clear the jam, the fasteners must be removed. It is disclosed to provide a front panel with an enlarged transverse pivot point defined by a closed loop to facilitate pivoting movement of the front panel away from a rear nose and the adjacent magazine to provide sufficient access by the user for removing the unwanted fasteners. In practice, there is insufficient clearance provided by this pivoting action to clear all jams.

In some applications, users of such tools employ a variety of fastener gauges. In some cases, it has been found that the use of relatively larger fasteners causes excess friction between the fastener and the front plate, to the extent that continual use with larger fasteners shaves metal from the fastener. This friction increases the tool temperature, reducing overall tool performance and increasing the chances of jamming and misfiring. Ultimately, the tool becomes nonfunctional.

SUMMARY

The above-identified need is met by providing a tool free interchangeable fastener guide for a fastening tool. In the preferred embodiment, the fastener guide locates upon the tool, and is secured to the tool both at the top of a front plate and using a lower locking mechanism for positively securing the front plate to the rear nose during tool operation. The lower locking mechanism allows the front plate to be unlocked quickly, and the upper configuration of the front plate allows the front plate to be opened to clear jams or to be completely removed without disassembling the tool. With this removable, interchangeable configuration, the front plate can be opened to more easily clear jams, or can be replaced with a different configuration front plate to allow for the firing of several different gauge and/or type fasteners using the same tool.

An upper end of the front plate is provided with an open "U"-shaped slot for engaging a transversely oriented, captured pin. The resulting engagement enables the front plate to be pivoted away from the rear nose for jam clearing, and also enables total removal and replacement of the front plate when converting to a different sized fastener.

More specifically, a tool-free interchangeable fastener guide is provided for use with a fastener tool having a nosepiece with a captured transverse pin and a back plate. The guide includes a front plate having a tool engaging end and an opposite fastener outlet end, an outer surface and an inner surface. A butt plate is pivotably joined to the outer surface. A spring clip has a first end pivotably secured to the butt plate, and a second end configured for attachment to the fastener tool. The tool engaging end has an open slot constructed and arranged for pivotally engaging the captured pin, allowing the front plate to be disengaged from the captured pin without the use of tools.

In another embodiment, a fastener driving tool is provided, including a housing at least partially enclosing a combustion power source. A nosepiece is disposed at an end of the housing, the nosepiece including a retaining cup having a captured pin. The nosepiece further includes a front plate having a tool engaging end and an opposite fastener outlet end, an outer surface and an inner surface. A butt plate is pivotably joined to the outer surface. A spring clip has a first end pivotably secured to the butt plate, and a second end configured for attachment to the nosepiece. The tool engaging end has an open slot constructed and arranged for pivotally engaging the captured pin, the front plate being disengageable from the captured pin without the use of tools.

In still another embodiment, a front plate is provided that is configured for use in a nosepiece of a fastener driving tool, and includes a body defining a longitudinal axis and having a tool engaging end and an opposite fastener outlet end, an outer surface and an inner surface. The inner surface defines a fastener passageway. A slot is defined at the tool engaging end and is generally U-shaped when viewed from a side. The slot further includes an arcuate portion joining two leg portions, each leg portion including a first segment extending generally parallel to the longitudinal axis of the body, and a second segment extending at an angle to the first segment.

DETAILED DESCRIPTION

Figure 2:
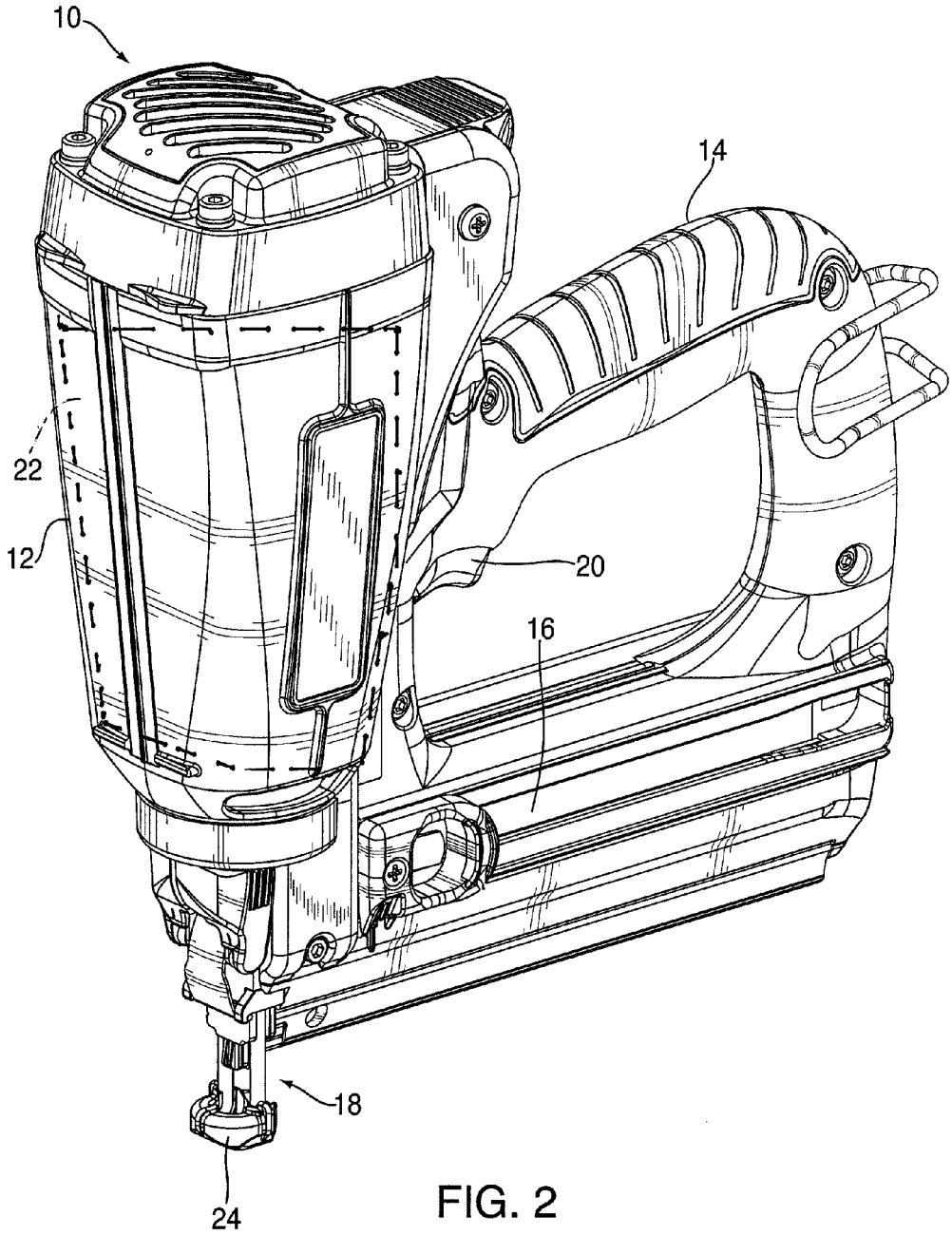
FIG. 2 is a top perspective view of fastener driver tool incorporating the present fastener guide.

Referring to FIG. 2, a combustion-powered tool suitable for driving trim-type fasteners is generally designated 10 and includes housing 12 with a handle 14, a fastener magazine 16 feeding fasteners to a nosepiece or nosepiece assembly 18, and a trigger 20 for operating a combustion power unit 22 (shown hidden). The housing 12 at least partially encloses the power unit 22. It will be understood that many of features described below, including the general appearance and operational details of such combustion powered tools for both framing and trim-type applications are well known in the art of combustion type nailers, and especially when reviewed in conjunction with the patents incorporated by reference above. Thus, the present tool 10 may be any powered fastener driver tool employing a break open nosepiece assembly 18 as described below.

In FIG. 2, the tool 10 is shown in a generally vertical orientation. However, other orientations of the tool 10 are contemplated as known in the art. The nosepiece assembly 18 is shown in a closed, normal operating position.

Figure 3:
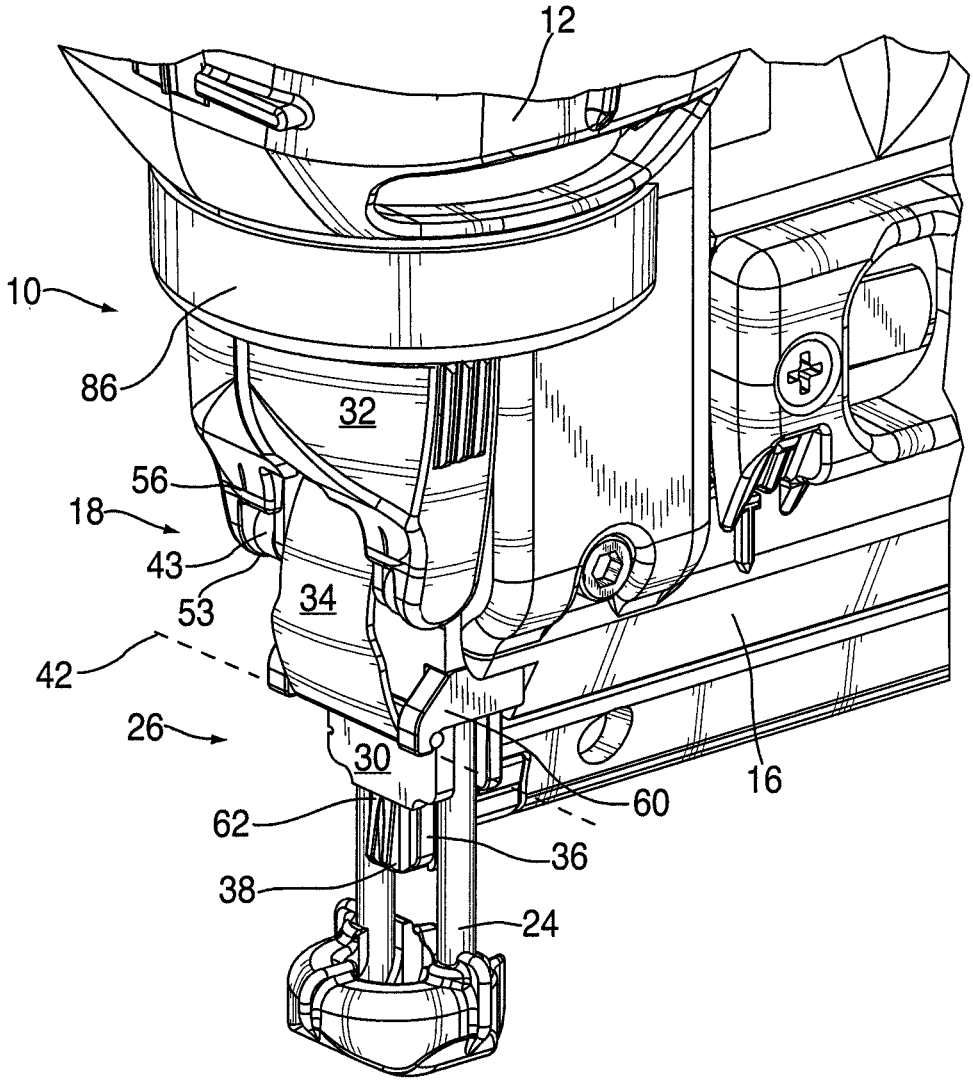
FIG. 3 is an enlarged fragmentary top perspective view of the fastener driver tool of FIG. 2.
Figure 4:
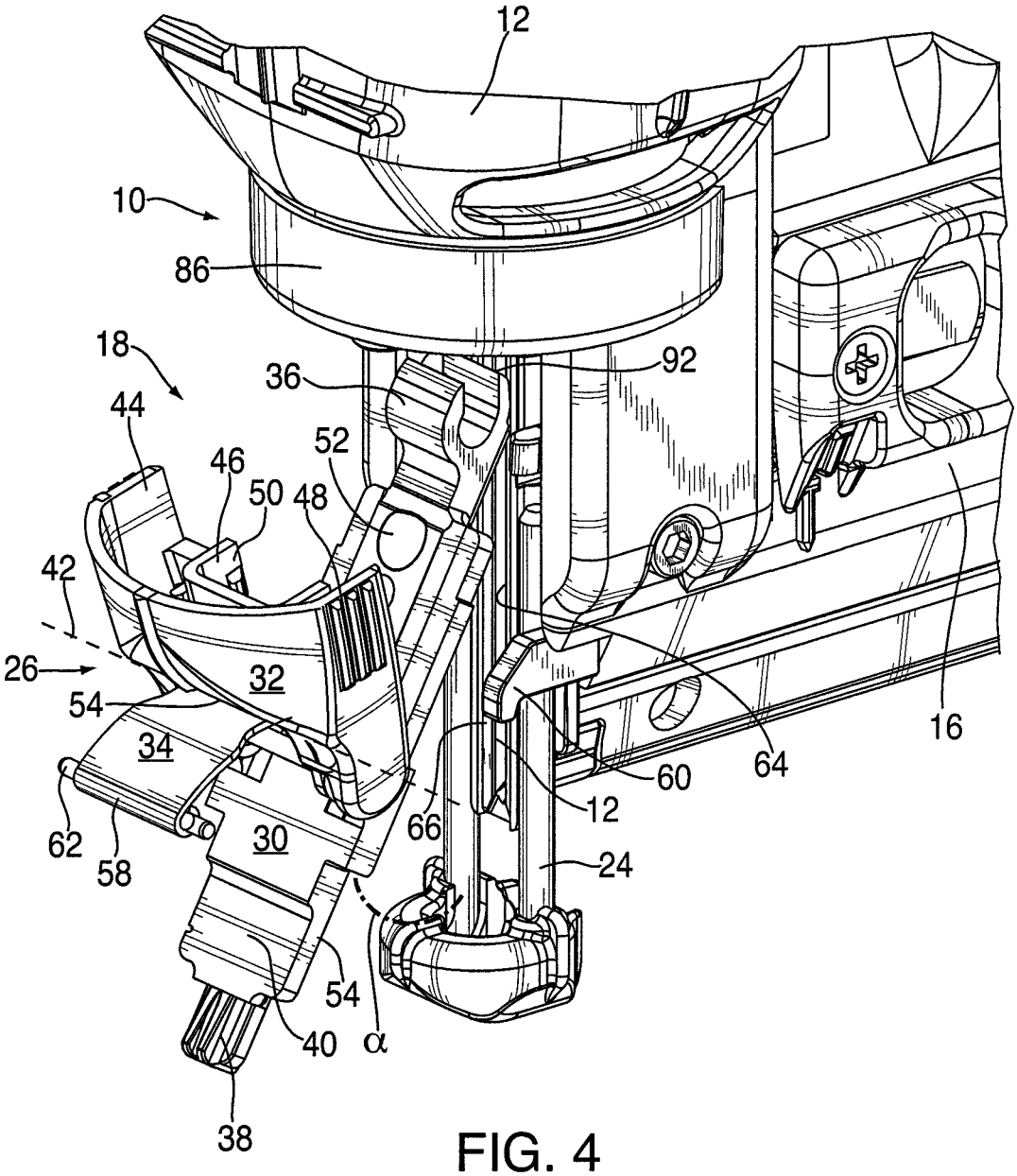
FIG. 4 is an enlarged fragmentary perspective of the tool of FIG. 2 depicting the front plate assembly in the open and removable position.
Figure 5:
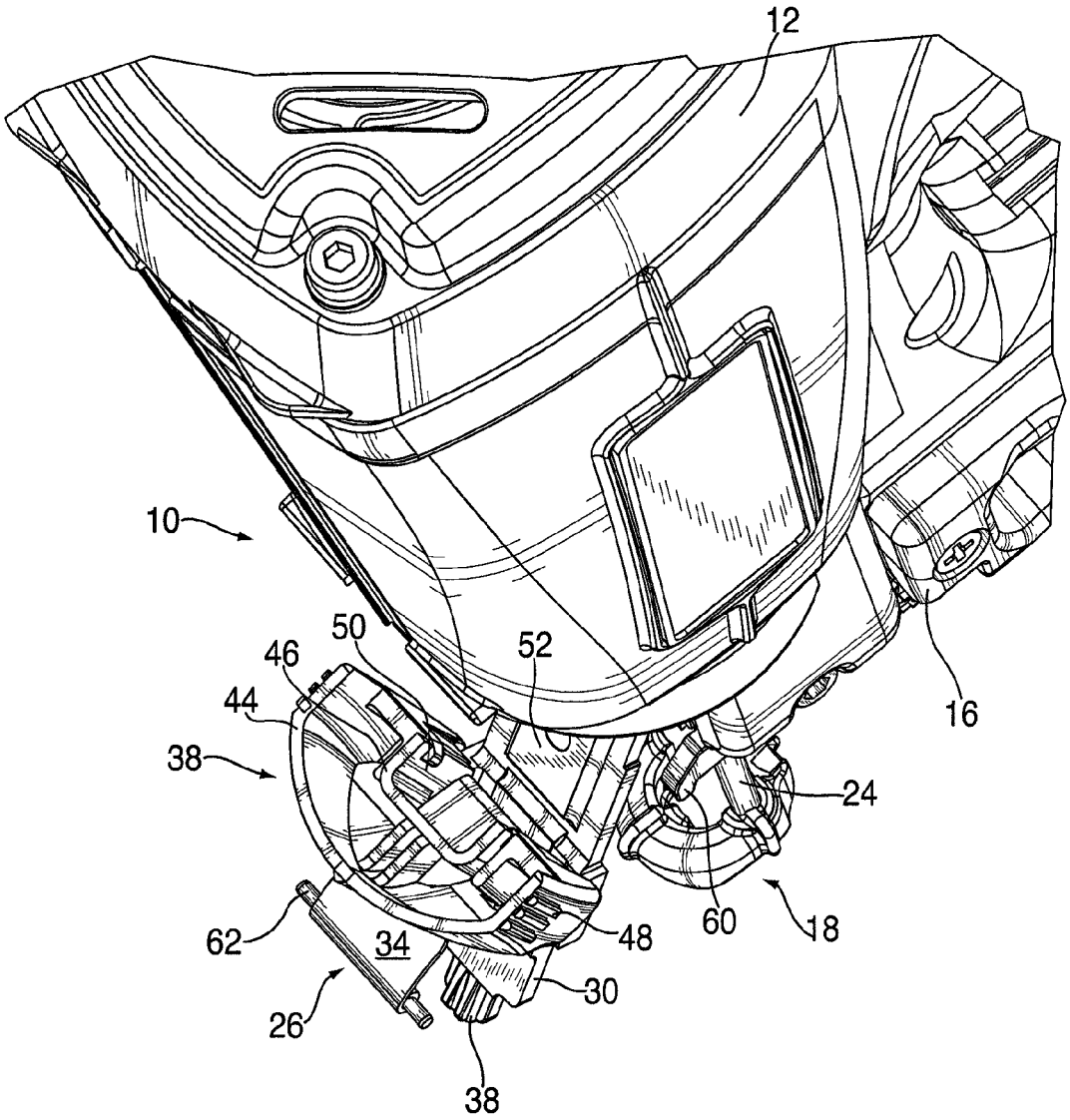
FIG. 5 is a fragmentary top perspective view of the tool of FIG. 2 depicting the front plate assembly in the open position.

As shown in FIGS. 3-5, the nosepiece assembly 18 includes a workpiece contact element 24 and a fastener guide 26. As is known in the art, the workpiece contact element 24 contacts the workpiece prior to the driving of a fastener, and reciprocates axially relative to a remainder of the nosepiece assembly 18. Optionally included on the tool 10 is a fastener depth adjustment mechanism (not shown) that provides adjustability of the depth fasteners are driven into the workpiece. Included on the fastener guide 26 is a front plate 30, a quick clear latch cover, also known as a butt plate 32 and a spring clip 34. While other materials are contemplated, the front plate 30 is preferably made of metal, such as cast steel or the like, the butt plate 32 is largely made of molded plastic, and the spring clip 34 is made of spring steel. The fastener guide 26 is generally freely pivotable between a closed position seen in FIG. 3 and an open position seen in FIGS. 4 and 5.

The front plate 30 has a tool engaging end 36 and an opposite fastener outlet end 38. An outer surface 40 of the front plate 30 pivotably receives the butt plate 32, and such pivoting action preferably occurs about an adjoining axis 42 defined by a pair of spaced eyelets 43 integral with the front plate 30 (FIG. 3) disposed transverse to a longitudinal axis of the fastener guide 26, but other arrangements are contemplated. In the preferred embodiment, the butt plate 32 has an outer, shell-like portion 44 and an inner portion 46. At least one and preferably several parallel grip bars 48 are provided on each side of the outer portion 44 of the butt plate 32, allowing the operator to easily grasp the butt plate 32 for pivoting the butt plate about the adjoining axis 42 between the open and closed positions.

A rear surface 50 of the inner portion 46 is configured for engaging the outer surface 40 of the front plate 30, which preferably has a forwardly projecting, generally rectangular boss 52. In the preferred embodiment, the outer portion 44 of the butt plate 32 is plastic, and the inner portion 46 is a stronger, durable, more rigid material such as metal. However, other materials are contemplated. Included on the inner portion 46 is a pair of depending arms 53 (FIG. 3) that pivotably engages the adjoining axis 42.

A fixed end 54 of the spring clip 34 is pivotably secured to a generally inverted "U"-shaped cavity 56 (FIG. 3) defined by the butt plate 32, and more specifically, is secured to the legs 53 of the inner portion 46 along an axis 57 (shown hidden in FIG. 6) in spaced parallel relationship to the adjoining axis 42, and an opposite locking end 58 of the spring clip 34 is configured for attachment to the tool 10. Specifically, a pair of forward projecting, inverted hooks 60 receive ends of a laterally projecting pin 62 to secure the fastener guide to the tool 10. When the butt plate 32 is moved to the closed position (FIG. 3), it exerts an over-center cam effect on the spring clip 34, tensioning the clip and forcing the butt plate against the front plate 30, and clamping the fastener guide 26 against the tool 10.

When an operator wants to open the fastener guide 26, the butt plate 32 is grasped and pivoted about the adjoining axis 42 away from the tool housing 12, and the fixed end 54 of the spring clip 34 attached to the butt plate 32 correspondingly shifts the locking end 58 along the outer surface 40 of the front plate 30, thereby releasing each end of the pin 62 from the inside of each corresponding hook 60. The fastener guide 12 can then pivot to the open position shown in FIG. 4.

Figure 9:
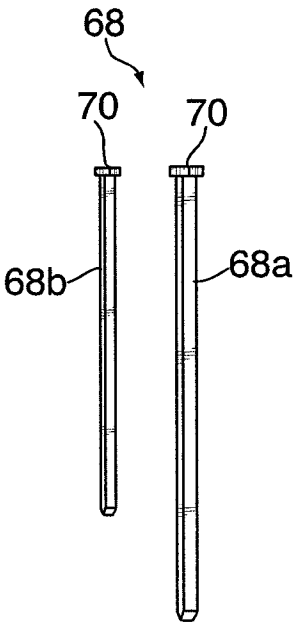
FIG. 9 is an elevational view of two gauges of fasteners compatible with the present fastener guide.

Referring now to FIGS. 4 and 5-7, the front plate 30 engages a back plate or rear nose 64 and in the closed position, these components combine to define a passageway or track 66 for a driver blade (not shown) and fasteners 68 (FIG. 9). The track 66 extends the full length of the nosepiece assembly 18, and is preferably dimensioned to slidingly receive a head 70 of the fasteners 68. Thus, the back plate 64, along with the fastener guide 26 and the workpiece contact element 28 forms the nosepiece assembly. An inner surface 72 of the front plate 30 defines a front portion 74 of the fastener passageway 66.

Figure 1:
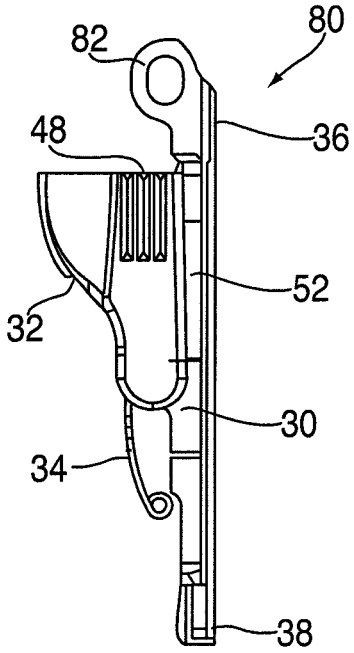
FIG. 1 PRIOR ART
FIG. 1 is a fragmentary side view of a prior art fastener guide plate.

Referring now to FIG. 1, a conventional, prior art fastener guide is generally designated 80, and is similar to the type disclosed in U.S. Pat. No. 6,651,862 incorporated by reference. The fastener guide 80 shares many components with the present fastener guide 26, and these are indicated with identical reference numbers. A main distinction between the prior art guide 80 and the present guide 26 is that the prior guide has a tool engaging end 36 defining a transverse, closed loop 82. Preferably, the loop 82 is not circular but is oval to enhance the pivot travel of the fastener guide when in the open position.

Figure 8:
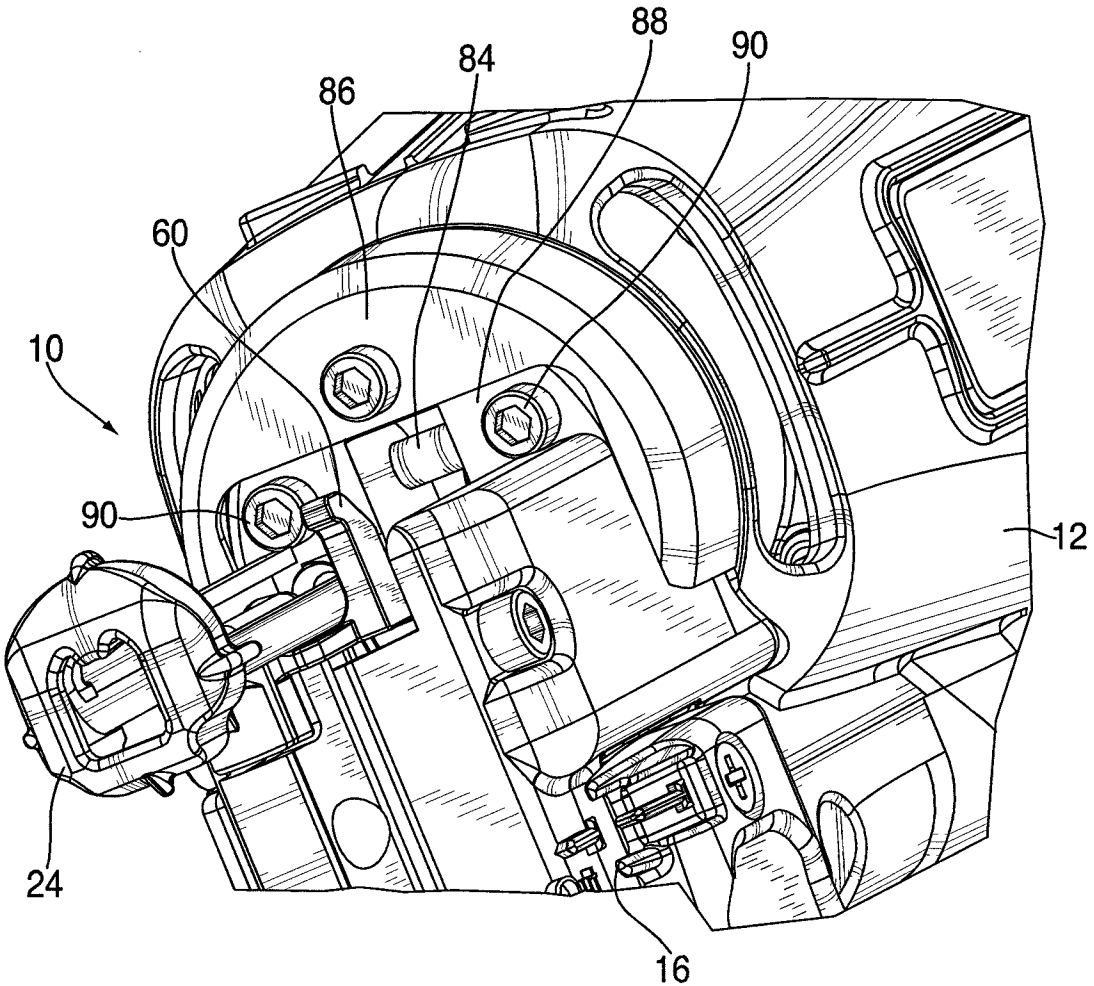
FIG. 8 is a fragmentary bottom perspective of the tool as shown in FIG. 2 with the front plate removed exposing the captured pin.

Referring now to FIG. 8, a major drawback of the prior art guide 80 is that the loop 82 matingly engages a captured transverse pin 84 enclosed by a retaining cup 86 and held in place by a clamp 88 secured by fasteners 90. When the fastener guide 80 requires replacement, the tool 10 must be almost completely disassembled, including removal of the retaining cup 86. Further, the clamp 88 must be removed to access the captured pin 84 to allow disengagement of the loop 82 from the pin 84. As seen in FIGS. 2 and 3, it will be seen that in the closed position, an upper edge of the butt plate 32 is disposed adjacent the retaining cup 86.

Such disassembly of the captured pin 84 would be required when using larger fasteners such as 14 gauge fasteners **68*a* shown in FIG. 9 in the prior art fastener guide 80 in order to provide the necessary clearance for the larger gauge fasteners. The 14 gauge fastener 68*a* is thicker and in some cases considerably longer than the 16 gauge fastener 68*b* for which the conventional fastener guide 80 is designed. It has been found that the use of the larger 14 gauge fasteners 68*a* in the tool 10 produced sheared off metal shavings, due to a necessary built in interference, which generates excess friction between the fastener and the front plate 30, increasing the temperature of the tool, reducing overall performance, impeding the return of the driver blade and eventually rendering the tool inoperable. If replacement of the fastener guide 80 is required, several steps for disassembling the captured pin 84** as described above are involved.

Figure 6:
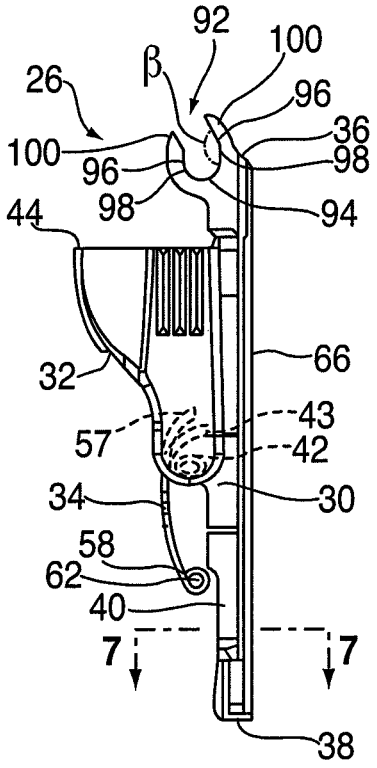
FIG. 6 is a side elevation of the present fastener guide.
Figure 7:
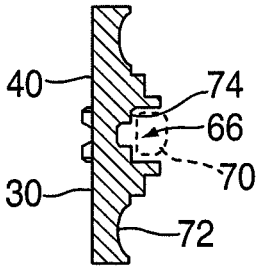
FIG. 7 is a cross-section taken along the line 7-7 of FIG. 6 and in the direction indicated generally.

Referring now to FIGS. 4 and 6, to avoid the above-described problems of the prior art fastener guide 80, the present fastener guide 26 is provided with a transverse, open slot 92 configured for pivoting about the captured pin 84, which also defines a pivot axis. In the preferred embodiment, the slot 92 is transverse to a longitudinal axis of the front plate 30, and is generally U-shaped when viewed from the side, having an arcuate portion 94 joining two leg portions 96. A first segment 98 of each of the leg portions 96, located closest to the arcuate portion 94, is generally parallel to a longitudinal axis of the front plate 30, and a second segment 100 of each of the leg portions 96 extends at an angle β to the first segment 98. In the preferred embodiment, β is obtuse and is in the range of 120 to 160 degrees, and more preferably approximately 140 degrees relative to the first segment. Further, in the preferred embodiment, one of the second segments 100 is longer than the other, and projects farther from the arcuate portion 94.

Referring now to FIGS. 3 and 8, the fastener guide 26 is secured to the tool 10 by engagement between the open slot 92 and the captured pin 84. An initial angle α of the fastener guide 26 in the open position (FIG. 4) can range from about 30 degrees to 90 degrees, so long as the fastener guide is removable from the tool 10. However, other angles are contemplated. The total range of motion of the fastener guide 26 is larger than that of the fastener guide 80, facilitating the greater access to the fastener passageway 66 and the clearance of jammed fasteners. Each front plate 30 is preferably configured for accommodating at least one of 14 gauge and 16 gauge finishing nails, respectively 68*a* and 68*b* as seen in FIG. 9. However, with the ease of attachment and replacement of the present fastener guide 26, it is contemplated that a separate fastener guide 26 is provided for each specific fastener size to overcome the friction encountered in conventional tools 10 when larger than designed fasteners are used. With the present fastener guide 26, the user can replace the standard fastener guide 80 of FIG. 1 with the present fastener guide 26 by disassembling the tool 10 as described above one additional time. Subsequent replacements of the fastener guide 26 are achieved without requiring disassembly of the tool 10 and without the use of tools.

While a particular embodiment of the present tool free interchangeable fastener guide has been shown and described, it will be appreciated by those skilled in the art that changes and modifications may be made thereto without departing from the invention in its broader aspects and as set forth in the following claims.

What is claimed:

1. A tool free interchangeable fastener guide for use with a fastener tool having a nosepiece with a pivot pin and a back plate, said guide comprising:

a front plate having a tool engaging end and an opposite fastener outlet end, an outer surface and an inner surface, and a substantially flat, rigid body defined by said outer and inner surfaces;

a butt plate pivotably joined to said outer surface;

a spring clip having a first end pivotably secured to said butt plate; and a second end configured for attachment to the fastener tool, both said butt plate and said spring clip being positioned in front of said outer surface; and said tool engaging end having a slot including a cavity constructed and arranged for pivotally engaging the pivot pin, said front plate being disengageable from the pivot pin without the use of tools.

2. The fastener guide of claim 1 wherein said slot is transverse to a longitudinal axis of said front plate.

3. The fastener guide of claim 1 wherein said slot is generally U-shaped when viewed from a lateral side relative to a longitudinal axis of said front plate.

4. The fastener guide of claim 3 wherein said slot further includes an arcuate portion joining two leg portions, each said leg portion including a first segment extending parallel to a longitudinal axis of said front panel, and a second segment extending at an angle to said first segment.

5. The fastener guide of claim 1 wherein said inner surface defines a fastener passageway.

6. The fastener guide of claim 1 wherein said butt plate engages said front plate along a transverse axis.

7. The fastener guide of claim 1 wherein said spring clip pivotably engages said butt plate about a transverse axis.

8. The fastener guide of claim 1 wherein the tool has a pair of forwardly extending hooks, and said spring clip is provided with a laterally extending pin, each end of which is configured for engaging a corresponding one of the hooks.

9. The fastener guide of claim 1 wherein said front plate is configured for accommodating at least one of 14 gauge and 16 gauge finishing nails.

10. A fastener driving tool, comprising:

a housing at least partially enclosing a combustion power source;

a nosepiece disposed at an end of said housing, said nosepiece including a retaining cup having a pivot pin;

said nosepiece further including a front plate having a tool engaging end and an opposite fastener outlet end, an outer surface and an inner surface;

a butt plate pivotably joined to said outer surface for pivoting about an adjoining axis transverse to a longitudinal axis of said front plate, said adjoining axis being positioned at approximately half a longitudinal length of said front plate;

a spring clip having a first end pivotably secured to said butt plate; and a second end configured for attachment to said nosepiece; and said tool engaging end having a slot including a cavity constructed and arranged for pivotally engaging said pivot pin, said front plate being disengageable from said pivot pin without the use of tools.

11. The tool of claim 10 wherein said slot is generally U-shaped when viewed from a lateral side relative to a longitudinal axis of said front plate, said slot further includes an arcuate portion joining two leg portions, each said leg portion including a first segment extending parallel to a longitudinal axis of said front panel, and a second segment extending at an angle to said first segment.

12. A front plate configured for use in a nosepiece of a fastener driving tool, comprising:

a body defining a longitudinal axis and having a tool engaging end and an opposite fastener outlet end, an outer surface and an inner surface;

said inner surface at least partially defines a fastener passageway;

a slot defined at said tool engaging end, said slot is generally U-shaped when viewed from a lateral side relative to said longitudinal axis of said front plate, said slot further includes an arcuate portion joining two leg portions, each said leg portion including a first segment extending generally parallel to the longitudinal axis of said body, and a second segment extending at an angle to said first segment.

13. The front plate of claim 12 further including said front surface having a forwardly projecting rectangular boss.

14. The front plate of claim 12 wherein one of said leg portion segments is longer than the other.

15. The front plate of claim 12 wherein said angle is obtuse.

* * * * *